US011585106B2

(12) United States Patent
Schneider et al.

(10) Patent No.: US 11,585,106 B2
(45) Date of Patent: Feb. 21, 2023

(54) SIDE PROTECTOR, CEILING FORMWORK SYSTEM HAVING AT LEAST ONE SUCH SIDE PROTECTOR, AND METHOD FOR ERECTING SUCH A SIDE PROTECTOR

(71) Applicant: Peri GmbH, Weissenhorn (DE)

(72) Inventors: Werner Schneider, Erbach (DE); Gisbert Eppelt, Pfaffenhofen (DE)

(73) Assignee: PERI SE, Weissenhorn (DE)

( * ) Notice: Subject to any disclaimer, the term of this patent is extended or adjusted under 35 U.S.C. 154(b) by 581 days.

(21) Appl. No.: 16/092,205

(22) PCT Filed: Mar. 1, 2017

(86) PCT No.: PCT/EP2017/054812
§ 371 (c)(1),
(2) Date: Oct. 8, 2018

(87) PCT Pub. No.: WO2017/174264
PCT Pub. Date: Oct. 12, 2017

(65) Prior Publication Data

US 2020/0332540 A1 Oct. 22, 2020

(30) Foreign Application Priority Data

Apr. 8, 2016 (DE) ..... 10 2016 205 957.2

(51) Int. Cl.
*E04G 17/00* (2006.01)
*E04G 11/38* (2006.01)
*E04G 21/32* (2006.01)

(52) U.S. Cl.
CPC ..... *E04G 17/002* (2013.01); *E04G 11/38* (2013.01); *E04G 21/3204* (2013.01)

(58) Field of Classification Search
CPC ... E04G 17/002; E04G 21/3204; E04G 5/001; E04G 5/14; E04G 5/144; E04G 5/147; E04G 11/38
See application file for complete search history.

(56) References Cited

FOREIGN PATENT DOCUMENTS

| | | | | |
|---|---|---|---|---|
| DE | 102012012118 A1 * | 12/2013 | ..... | E04G 5/06 |
| DE | 202018101994 U1 * | 8/2019 | ..... | E01D 19/106 |
| EP | 2757212 | 7/2014 | | |
| KR | 20130099581 A * | 9/2013 | ..... | E04G 5/14 |
| WO | WO-2006089975 A2 * | 8/2006 | ..... | E04G 11/38 |

* cited by examiner

*Primary Examiner* — Michael Safavi
(74) *Attorney, Agent, or Firm* — Wei & Sleman LLP

(57) ABSTRACT

A side protector for ceiling formwork. The ceiling formwork comprises at least one formwork element having a frame. The side protector has a railing. Furthermore, the side protector has a pivoting frame. The railing is connected to the pivoting frame. The pivoting frame can be connected indirectly or directly to the frame from the bottom side of the ceiling formwork. The pivoting frame can be pivoted from an installation position into an end position about an axis of rotation (A) in such a way that the ceiling formwork is laterally secured by the railing. Furthermore, a ceiling formwork system, having at least one corresponding side protector and ceiling formwork, is specified. In addition, a method for erecting such a side protector is specified.

16 Claims, 18 Drawing Sheets

SIDE PROTECTOR, CEILING FORMWORK SYSTEM HAVING AT LEAST ONE SUCH SIDE PROTECTOR, AND METHOD FOR ERECTING SUCH A SIDE PROTECTOR

FIELD OF THE INVENTION

The invention relates to a side protector for ceiling formwork, wherein the ceiling formwork comprises at least one formwork element having a frame. The invention further relates to a ceiling formwork system having at least one such side protector, and a method for erecting such a side protector.

BACKGROUND OF THE INVENTION

The use of a ceiling formwork made of formwork elements to build concrete ceilings is known. In particular, frame panel formwork elements are used that at least partially form a mold to be filled with liquid concrete. To produce a concrete ceiling, a ceiling formwork supported by ceiling supports is first constructed. A desired room height can be achieved by the positioning of the ceiling formwork at a specific height. The standard room height in Germany for single-family homes, duplexes and row houses is at least 2.40 meters, wherein commercial properties can have a significantly larger room height. The liquid concrete filling operation on the ceiling formwork is carried out by workers who must issue on the ceiling formwork for this purpose. In order to protect these workers against a life-threatening fall from the ceiling formwork during the concrete filling operation, a side protector is installed on the ceiling formwork. For this purpose, side railing brackets, into which side railings are mounted, are laterally attached to the ceiling formwork. The ceiling formwork is laterally secured via the side railings and a fall of the workers from the ceiling formwork is prevented. The installation of the side protector is generally carried out by workers who must walk on the ceiling formwork to do this.

This is problematic in that there is an increased risk of the workers falling from the ceiling formwork during installation of the side protector.

SUMMARY OF THE INVENTION

The object of the present invention is thus to design and further develop the known side protector in such a manner that it enables a safe installation.

This object is achieved by a side protector, by a ceiling formwork system having at least one side protector of this type and by a method for erecting such a side protector The object according to the invention is thus achieved by a side protector for a ceiling formwork. The ceiling formwork comprises at least one formwork element having a frame. The side protector has a railing. The side protector further has a pivoting frame, to which the railing is connected and which can be connected directly or indirectly to the frame of a formwork element from the bottom side of the ceiling formwork. The pivoting frame can be moved from an installation position about an axis of rotation A into an end position in such a manner that the railing of the ceiling formwork is laterally secured in the area of the free edge of a formwork element.

According to the invention, the pivoting frame is thus first directly or indirectly installed on the frame of a formwork element on secure ground. The pivoting frame together with the railing attached to the pivoting frame is then also pivoted out from an installation position into an end position on secure ground in such a manner that the ceiling formwork is laterally secured by the railing. The safeguarding of the free edge of the ceiling formwork is always achieved by the lateral securing. Although the pivoting frame is directly or indirectly connected to the frame of the formwork element in the installation position, the pivoting frame is, however, not yet swung up. In the end position, the rail projects laterally upwardly beyond the ceiling formwork. Upwardly beyond the ceiling formwork here means that the railing extends in a direction facing away from the ground from the ceiling formwork arranged parallel to the ground.

Workers thus do not need to walk on the unsecured ceiling formwork to attach the side protector. The ceiling formwork is already laterally secured for walking on the ceiling formwork while the formwork element is being filled with liquid concrete. A life-threatening fall from the ceiling formwork when the ceiling formwork is first walked on is thus prevented according to the invention. A safe installation of the side protector according to the invention is ensured.

The pivoting frame can be connected directly to the frame of the formwork element. For example, the pivoting frame can be articulated directly at the frame. It would also be possible that the pivoting frame is fixedly connected, e.g. adhesively bonded, latched, screwed or welded to the frame. The pivoting frame is preferably pivotably connected to the frame, however, namely via a mounting rail as according to the invention. In this manner, the mounting rail can be connected to the frame and the pivoting frame can be pivotably connected to the mounting rail about an axis of rotation A. In the installed state, the mounting rail preferably has a horizontal alignment or orientation.

The pivoting frame can comprise a pivoting base frame and a pivoting flap. The pivoting flap is pivotably connected to the pivoting base frame about an axis of rotation B. The pivoting base frame can have two longitudinal members. The longitudinal members can be connected to each other via a plurality of crossbeams. The cross-section of the longitudinal members can have different geometrical shapes just like the crossbeams. A cylindrical or any polyhedral form, for example, would be conceivable. The longitudinal members are, in any case, preferably designed having a rectangular cross-section and the crossbeams are designed having a square cross-section. The longitudinal members can further be solidly produced of a solid material just like the crossbeams. However, the longitudinal members and the crossbeams are preferably designed as hollow profiles. This carries a weight advantage with respect to the solid construction. Alternatively or additionally to this, the longitudinal members can be connected to each other via transverse connectors. The transverse connectors are designed as flat plates. Longitudinal members, crossbeams and/or transverse connectors can be made from plastic or wood. However, these are preferably made of metal, for example, of aluminum or steel. The crossbeams and the transverse connectors can be fixedly connected to each other, for example, adhesively bonded, latched, screwed or welded.

The longitudinal members can be designed in two pieces, namely having a first longitudinal member part and a second longitudinal member part at an angle to the first longitudinal member part. The first longitudinal member part and the second longitudinal member part can be fixedly connected to each other. A connection via a connecting element would be conceivable. It is also conceivable that the first longitudinal member part and the second longitudinal member part can be adhesively bonded, latched, screwed, positively or non-positively connected to each other. However, the first longitudinal member part and the second longitudinal member part are preferably welded to each other. The angle between the first longitudinal member part and the second longitudinal member part can be from 90 degrees to almost 180 degrees. However, the angle between the first longitudinal member part and the second longitudinal member part is preferably approximately 90 degrees. A pin can project away from each of the two first longitudinal member parts in the area of their free ends. Basically, the pin can only be arranged on those side surfaces of the corresponding first longitudinal members that enable the longitudinal axis of the pin arranged on one of the two first longitudinal members and the longitudinal axis of the pin arranged on the other of the two first longitudinal members to be within the same axis of rotation A. The side surfaces of the corresponding longitudinal member parts that are opposite the side surfaces with the pin can also have a pin. It is of particular importance here that the longitudinal axes of all pins must be within the same axis of rotation A. However, each of the two first longitudinal member parts preferably has a passage through which a pin extends. The pin extends on both sides away from the corresponding first longitudinal member part or projects out of the corresponding first longitudinal member part on both sides. Here also, the longitudinal axis of the pin extending through one of the two first longitudinal member parts and the longitudinal axis of the pin extending through the other of the two first longitudinal member parts must be within the same axis of rotation A.

In an additional embodiment, the axis of rotation A can run at a distance from the two first longitudinal members. In this embodiment, spacer support pieces that extend essentially at a right angle from the first longitudinal members are formed at the ends of the first longitudinal member parts. The pins are formed in the free end area of the spacer support pieces, which then are within the axis of rotation A.

If spacer support pieces are provided on the first longitudinal members, these are also then designed between the first longitudinal member parts and the second longitudinal member parts.

If pivoting frames are provided with and without spacer support pieces, these pivoting frames can thus be arranged crosswise. This means pivoting frames having spacer support pieces can run below frames without spacer support pieces. Thus, with the pivoting frame according to the invention with and without spacer support pieces, it is simultaneously possible to equip the longitudinal and transverse sides of a ceiling formwork with the side protector according to the invention.

The structurally identical mounting rails can be used for the two embodiments of pivoting frames with and without spacer pieces.

The pivoting flap can have two side pieces. The side parts can be designed as elongated plates that have a profiling on their side areas. The side parts can preferably have a step for attachment to the formwork element in the edge area on one of their longitudinal sides. The side parts can be made of plastic, metal or wood. However, it is preferable if the side parts are made of metal. The side parts can be connected together via an additional crossbeam. The cross-section of the at least one additional crossbeam can have different geometric shapes. For example, a rectangular, a cylindrical or any polyhedral form would be conceivable. However, the at least one additional crossbeam is designed with a square cross-section. The at least one additional crossbeam can be fixedly connected to the side parts, for example adhesively bonded, screwed or welded.

A coupling element can be arranged on the additional crossbeam. The coupling element can be fixedly connected to the at least one additional crossbeam, for example adhesively bonded, screwed or welded. A locking element is articulated at the coupling element about an axis of rotation C. The locking element can have at least one lug for engaging behind one of the plurality of crossbeams. The locking element can preferably have two identically configured side plates that each have a lug and are connected to each other by a connecting plate. The coupling element is arranged between the two side plates of the locking element and pivotably mounted via an additional pin that extends through the side plates of the locking element. In order to prevent an undesired release of the back-side engagement of one of the plurality of crossbeams, an elastic means can be provided between locking element and coupling element to generate a restoring force. The elastic means can be, for example, a spring or a rubber band.

The mounting rail is designed as a support. The cross-section of the support can have different geometric forms. For example, a rectangular, a cylindrical or any polyhedral form would be conceivable. The cross-section of the support is preferably designed as a square.

At least one mounting rail, in particular two pairs of mounting rails, can be arranged on the support. The mounting rails are designed as plates that have an essentially S-shape. Each of the mounting rails can have a first notch for receiving the pin on its end distanced from the support. The notch for receiving the pin can be shaped like a bent finger. In addition, the mounting rails with the support can each form an additional, second notch for engaging with a projection of the frame. The support and/or the mounting rails can be made of wood, plastic or from metal, for example of aluminum or of steel. The mounting rails can be fixedly connected to the support, for example adhesively bonded, screwed or welded. The two first longitudinal member parts can each be able to be positioned between one of the pair of mounting rails. Here, one mounting rail is to be arranged on each side of the corresponding longitudinal member part. The pin that extends away on both sides from the corresponding first longitudinal member part or from the spacer support piece can thus be pivotably mounted in the notches of the pair of mounting rails and can therefore come to rest on both sides with each in a notch of a mounting rail.

Alternatively or in addition to the mounting rails, a securing flap can be arranged on the support. The securing flap can have an abutment element. The abutment element can be designed as an essentially sickle-shaped plate and made of wood, plastic or of metal, for example aluminum or steel. The abutment element can further be fixedly connected to the support, for example adhesively bonded, screwed or welded. The abutment element can form an additional notch for an engagement with a projection just like the mounting rails with the support. In addition, the abutment element can have a taper for engaging into a passage opening of the frame. The taper can be designed as a wedge shape. The securing flap can further have a securing lever. The securing lever is pivotably connected to the support. For this purpose, the securing lever can have an additional passage and an additional pin can be provided on the support. The additional pin arranged on the support can extend through the additional passage of the securing lever. A loosening of the securing lever by the additional pin can be prevented by a cotter pin in the additional pin.

The railing can have two longitudinal struts. The longitudinal struts can be connected to each other via a plurality of crossbeams. The longitudinal struts and/or the transverse struts can be made of wood, plastic or metal and be fixedly connected to each other, for example adhesively bonded, screwed or welded. The longitudinal struts and/or the transverse struts can be made solid or designed as a hollow profile. A grid results from the connection of longitudinal struts to the transverse struts. The railing can be fixedly connected to the second longitudinal strut, for example, a corresponding longitudinal strut of the railing can be adhesively bonded, screwed or welded to a corresponding second longitudinal strut. However, the railing is preferably inserted into the pivoting frame. The second longitudinal support pieces of the pivoting frame are designed as hollow profiles for this purpose and the railing is inserted with each one of its longitudinal struts in each one of the respective hollow profiles. For this purpose, the longitudinal struts must necessarily have an outer diameter narrower than the interior diameter that the second longitudinal member pieces have, the latter being designed as hollow profiles. The corresponding longitudinal struts can be set in the corresponding hollow profile in a positive and/or non-positive locking manner.

The object is additionally achieved by a ceiling formwork system having at least one side protector of this type and a ceiling formwork. The at least one side protector is installed on the ceiling formwork. The ceiling formwork can comprise at least one formwork element. The formwork element can have a frame. If the ceiling formwork comprises only one formwork element, the at least one side protector can be installed on the frame of this formwork element. Alternatively, if the ceiling formwork comprises a plurality of formwork elements, the one side protector can be installed on the frame of one of these formwork elements.

If the pivoting frame is fully pivoted into the end position, the first longitudinal member parts are oriented essentially parallel to the formwork elements. To secure the pivoting frame to the formwork element in this position, the pivoting flap is fully pivoted with respect to the pivoting frame about the axis of rotation B in the direction of the pivoting frame. In this arrangement, the step formed in each of the side pieces of the pivoting flap comes to rest on the top side of the formwork element, whereby the pivoting frame is held supported on the formwork element. Simultaneously, the lug formed on each of the side plates of the locking element engages behind the closest of the plurality of crossbeams and locks to it, whereby a slippage of the step built into each side part of the pivoting flap from the top side of the formwork element is prevented. The side protector is thus secured to the ceiling formwork and fixed in position.

To release the side protector from the ceiling formwork, the catch of the lugs designed on each of the side plates must first be released from the closest of the plurality of crossbeams, and then the pivoting flap must be pivoted with respect to the pivoting frame about the axis of rotation B away from the pivoting frame, whereby the steps designed in each of the side pieces of the pivoting flap no longer rest on the top side of the formwork element. The release of the catch of the lug from the closest of the plurality of crossbeams can, however, only be executed from the bottom side of the formwork. The side protector, therefore, cannot be released from the ceiling formwork by an incorrect operation of the ceiling formwork by workers working on the ceiling formwork.

The object is further achieved by a method for erecting a previously described side protector. The method has a step of directly or indirectly connecting the pivoting frame to the frame. The method further has a step of connecting the railing to the pivoting frame. In addition, the method has a step of pivoting the pivoting frame out of an installation position about an axis of rotation A into an end position. In this method the pivoting frame is pivoted in such a manner that the railing laterally secures the ceiling formwork.

The term lateral securing is to be understood as the securing of the free edge of the ceiling formwork. In the end position, the rail projects upwardly beyond the ceiling formwork. Upwardly beyond the ceiling formwork in this case means that the railing extends from the ceiling formwork arranged parallel to the ground in a direction facing away from the ground.

In order to expand an already-existing ceiling formwork supported by ceiling supports, individual formwork elements are each hooked on two corners of their frames into a guide bar of a ceiling support and then swung up from secure ground.

In the step of connecting the pivoting frame to the frame, the pivoting frame can be fixedly connected to the frame, for example by adhesive bonding, screwing or welding. This can already take place before the swinging up, for example, if the corresponding formwork element to be swung up is still on the ground. It should be noted here that the pivoting frame is to be swung up with the formwork element in the step of swinging up the pivoting frame. In the case of a swinging up of this type in one step, the weight of formwork element and pivoting frame must be swung up all at once.

Alternatively, the pivoting frame can be articulated at the frame about the axis of rotation A in the step of connecting the pivoting frame to the frame. This connection can take place before or after the formwork element is swung up. The formwork element is swung up first, then the pivoting frame. A swinging up of the formwork element and the pivoting frame separately from each other has the advantage that the weight of the formwork element and of the pivoting frame does not need to be swung up at the same time. A swinging up of the formwork element along with the pivoting frame in one step is obviously also conceivable in this variant.

Alternatively, the formwork element can be swung up in a first step without having to be already connected to the pivoting frame. If the formwork element is positioned as a ceiling formwork element, the mounting rail is connected to the frame of the pivoting element in a step subsequent to this. The pivoting frame is then connected to the mounting rail, meaning it is hooked into the first notches via the pins. Alternatively, the mounting rail can also be installed on the frame of the formwork element before swinging up the formwork element if the formwork element is still on the ground. In this variant, formwork element and pivoting frame are swung up separately.

The mounting rail is installed with a side protector on the bottom side of any formwork element during the securing of the edge of a ceiling formwork with a side protector. The pivoting frame with the railing (the term pivoting frame with railing is to be understood here as the side protector that is made up of the first and the second longitudinal member pieces, the railing and locking elements) is hooked into the mounting rail and the railing must be pivoted by a pivoting of the pivoting frame from below in front of the free edge of the formwork in such a manner that the railing projects far enough over the formwork that there is a secure work protection for workers working on the ceiling formwork.

In a special embodiment of the side protector for formwork elements to secure the formwork elements along their longitudinal sides, the pivoting frame must be articulated via a mounting rail in the area of a formwork element that is mounted on a formwork element which is separated from the edge formwork element by an additional formwork element.

Should a transverse side of a formwork element be secured by a side protector according to the invention, the pivoting frame can thus be articulated on the bottom side of any formwork element or preferably via a mounting rail that is mounted on a formwork element directly following an edge formwork element.

Consequently, the side protector in an unaltered configuration can be optionally installed on the longitudinal or transverse side of a formwork element, whereby the free edge of the ceiling formwork can be secured on the longitudinal side of the formwork element or the transverse side of the formwork element.

If the pivoting frames cross over each other on the bottom side of formwork elements—in the case of simultaneous securing of a ceiling edge—at a corner of longitudinal and transverse sides, either a spacer support must be provided on a pivoting frame in such a way that it is possible for a superposed pivoting frame to be able to engage a pivoting frame located immediately above it in an overlapping manner, or notches must be provided on the pivoting frame located below it at the points at which two superposed pivoting frames meet when they are swung up fully into place.

Further features and advantages of the invention are presented in the following description of a plurality of exemplary embodiments of the invention, in the claims and in the figures of the drawing that shows details that are essential to the invention.

BRIEF DESCRIPTION OF THE DRAWINGS

The features shown in the drawing are depicted in such a way that the special features according to the invention can be made clearly visible. The various features can each be realized in variants of the invention individually or in groups in any combination.

Shown are.

DETAILED DESCRIPTION

Figure 1:
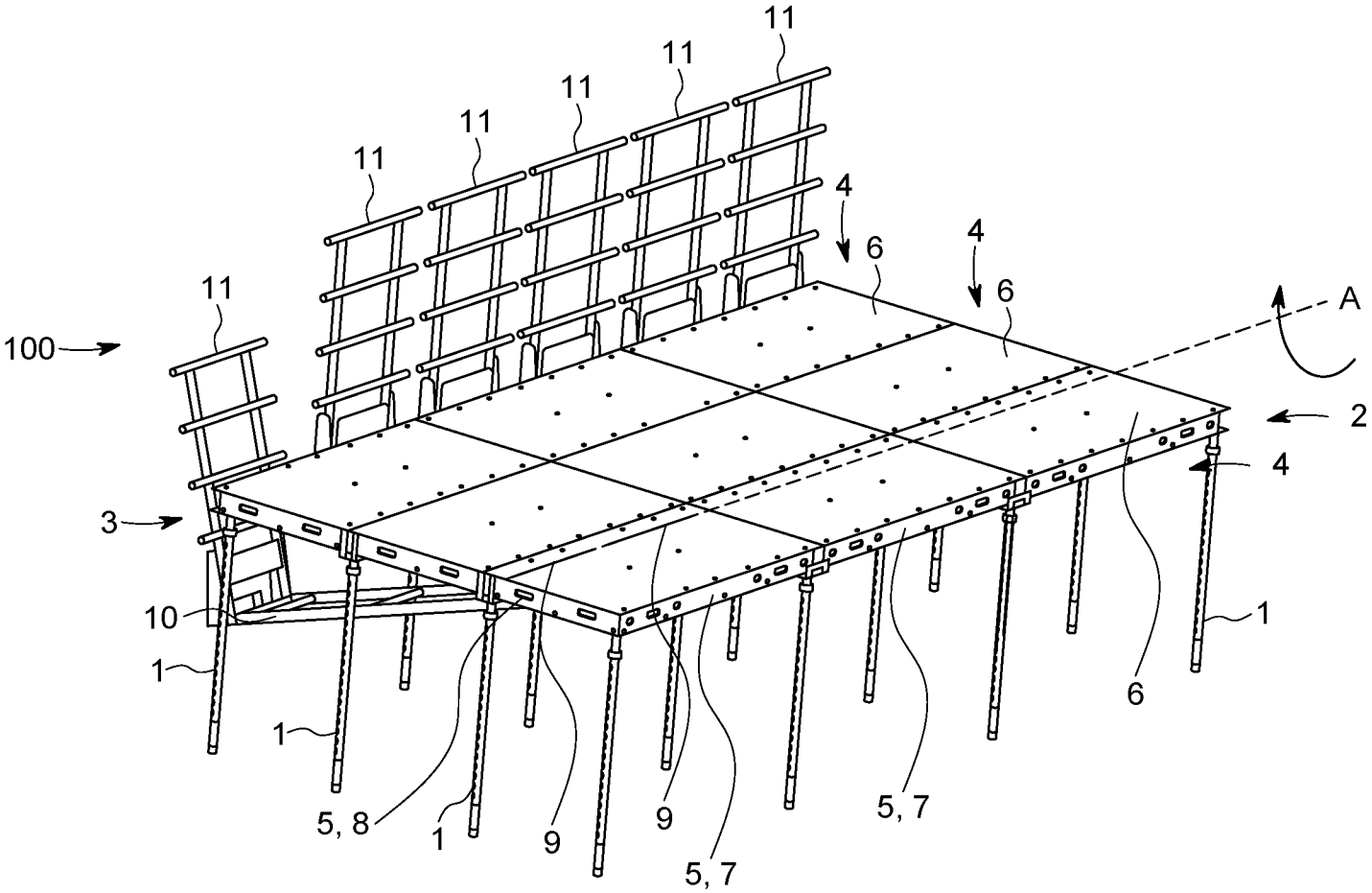
FIG. 1: a perspective view of a ceiling formwork system supported by ceiling supports having a side protector attached to a longitudinal side of the formwork element.

FIG. 1 shows a ceiling formwork system 100 supported by ceiling supports 1. Ceiling formwork system 100 comprises, in addition to a ceiling formwork 2, a plurality of elements of a side protector 3. Ceiling formwork 2 comprises a plurality of formwork elements 4. Two side protectors 3 each are installed on some of the plurality of formwork elements 4.

Formwork elements 4 are designed in the shape of frame panel formwork elements. Formwork elements 4 have a frame 5 and a formwork shell 6. Formwork elements 4 are oriented with their formwork shell 6 directed upward and are laterally joined to each other. Formwork elements 4 have a longitudinal side and a transverse side. Correspondingly, frame 5 has two longitudinal frame parts 7 extending parallel to each other and two transverse frame parts 8 extending parallel to each other. Longitudinal frame parts 7 and transverse frame parts 8 are oriented perpendicular to each other. Longitudinal frame parts 7 have double the length of transverse frame parts 8. Longitudinal frame parts 7 extend on the longitudinal side of formwork element 4. Transverse frame parts 8 extend on the transverse side of element part 4.

Side protector 3 has a pivoting frame 10, a railing 11 and a mounting rail 9. Mounting rail 9 is arranged below ceiling formwork 2, covered by formwork shell 6 and is indicated in FIG. 1 by a black bar (mounting rail 9). Railing 11 is connected to pivoting frame 10.

If, as depicted in FIG. 1, side protectors 3 are provided laterally with respect to the longitudinal side of formwork elements 4 arranged in the edge region of ceiling formwork 2, two mounting rails 9 each are installed next to each other on the longitudinal frame part 7 facing the longitudinal side to be protected of third formwork element 4—as seen from the longitudinal side of formwork element 4 to be protected.

If side protectors 3 are provided laterally with respect to the transverse side of formwork elements 4 arranged in the edge region of ceiling formwork 2 (not shown in FIG. 1), then mounting rail 9 is installed on the transverse frame part 8 facing toward the transverse side to be protected of second formwork element 4—as seen from the transverse side to be secured of formwork element 4.

After installation of mounting rail 9 on frame 5 of formwork element 4, pivoting frame 10 is hooked into mounting rail 9 from the ground and is pivotably mounted there about an axis of rotation A opposite mounting rail 9. Immediately after being hooked in, pivoting frame 10 is first positioned in an installation position. In the installation position, pivoting frame 10 is hooked into mounting rail 9, but not swung up. Pivoting frame 10 is then swung up from this installation position about an axis of rotation A into an end position. In the end position, side protector 3 laterally secures ceiling formwork 2 by railing 11. In the end position, side protector 3 projects upward with its railing 11 out over ceiling formwork 2.

Figure 2:
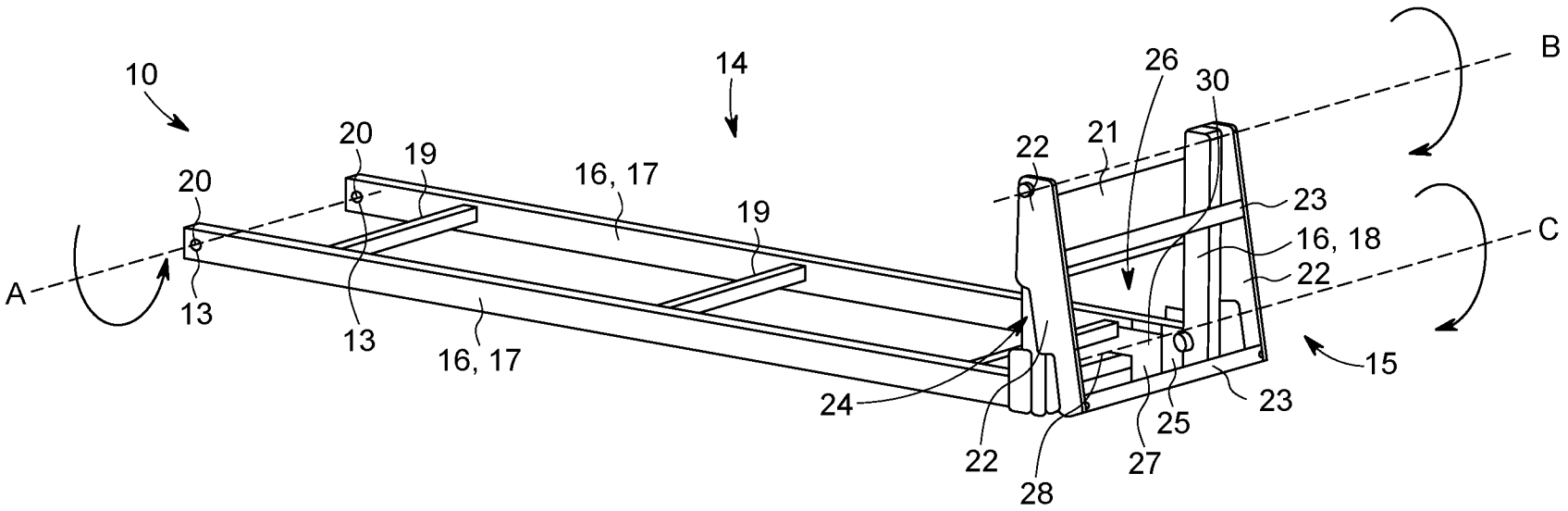
FIG. 2: a perspective view of a pivoting frame.

FIG. 2 shows pivoting frame 10. Pivoting frame 10 has a pivoting base frame 14 and a pivoting flap 15. Pivoting base frame 14 has two longitudinal members 16 arranged parallel. Longitudinal members 16 are designed as hollow profiles having a rectangular cross-section. Longitudinal members 16 each have a first longitudinal member part 17 and a second longitudinal member part 18. Second longitudinal member part 18 is arranged at an angle of 90 degrees with respect to first longitudinal member part 17. First longitudinal member parts 17 are connected to each other via crossbeams 19. Crossbeams 19 have a square cross-section. A through-hole 13 is provided in the end area of each first longitudinal member part 17 A pin 20 is arranged in through-hole 13 that extends through corresponding first longitudinal member 17 and projects from first longitudinal member 17 on both sides. The longitudinal axis of pin 20 that extends through the passage of one of the two first longitudinal member parts 17 and the longitudinal axis of pin 20 that extends through the passage of the other of the two first longitudinal member parts 17 are within the same axis of rotation A. Second longitudinal member parts 18 are connected to each other via a transverse connector 21. Transverse connector 21 is designed as a round rod/tube.

Figure 19:
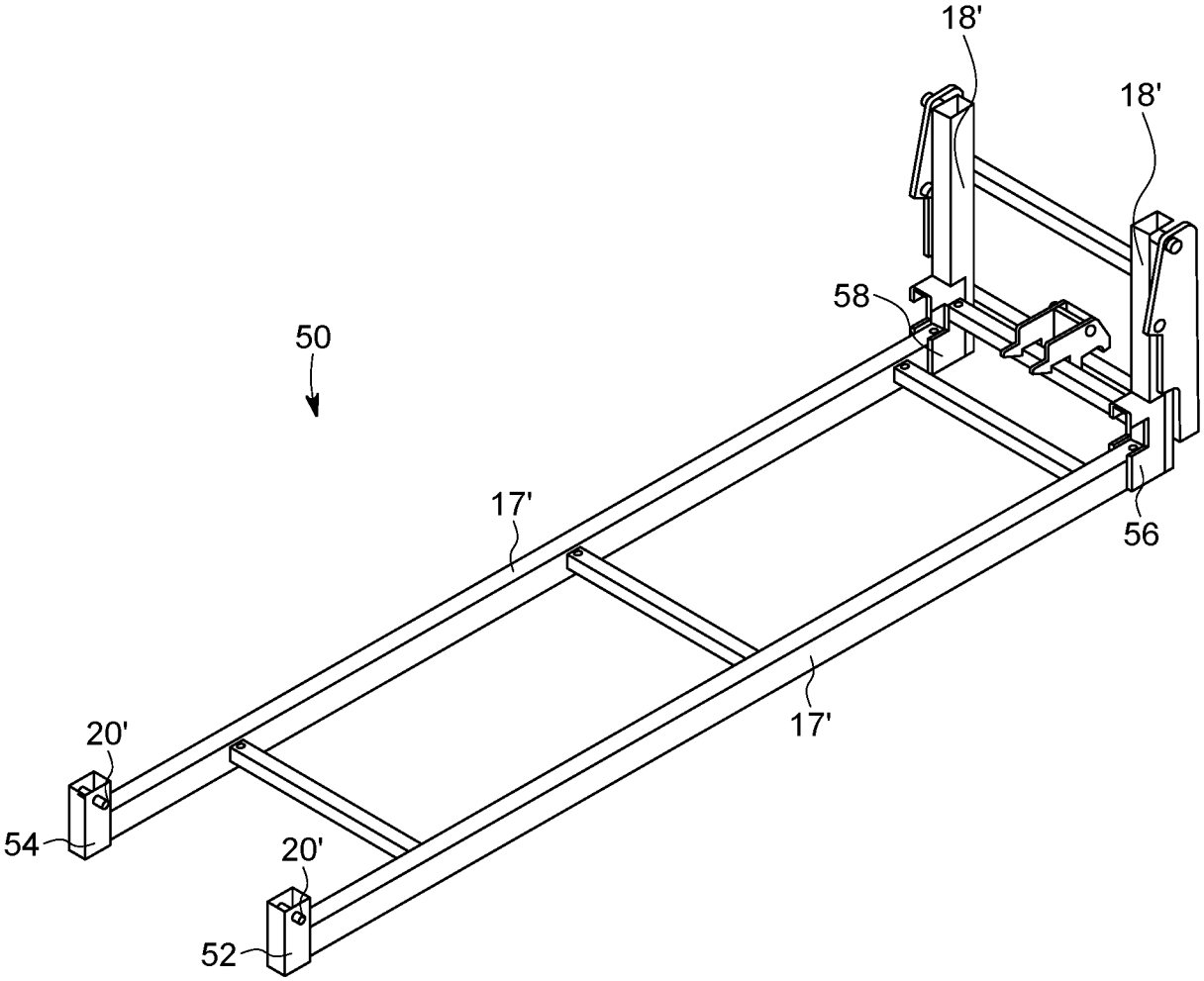
FIG. 19: a second exemplary embodiment of a pivoting frame having spacer support pieces in a perspective view.
Figure 20:
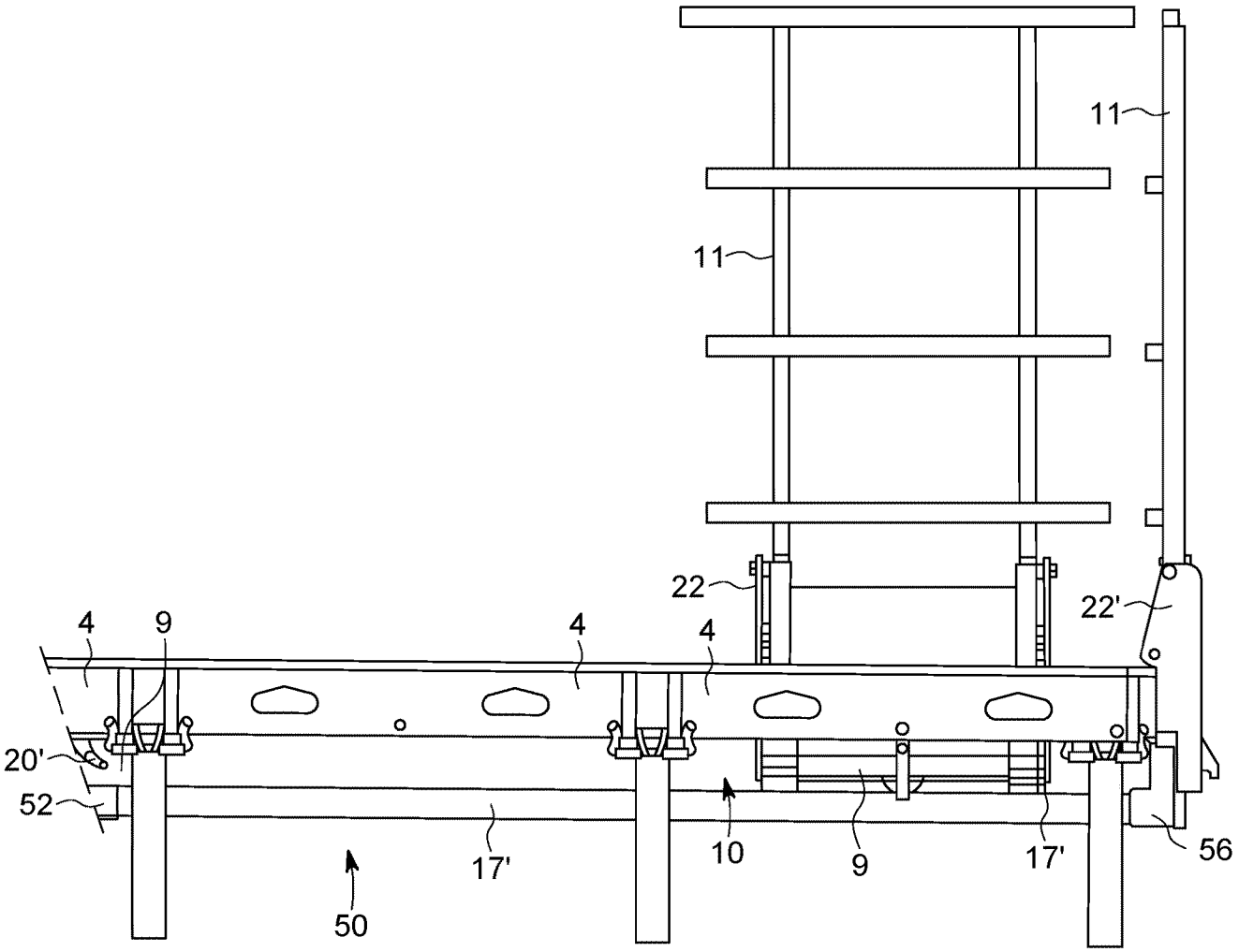
FIG. 20: a side view having overlapping pivoting frames with and without spacer support pieces.

In a further embodiment shown in FIGS. 19 and 20, pin or pins 20 are not designed or arranged in longitudinal member parts 17 but are rigidly fixed in end areas of spacer support pieces that are oriented upward at a right angle in the extension direction of second longitudinal members 18 at the ends of longitudinal member parts 17. In this embodiment, the spacer support pieces are also provided in the area between longitudinal member parts 17 and longitudinal member parts 18. The embodiment shown in FIG. 2 and the embodiment shown in FIG. 19 can be mounted overlapping each other on the bottom side of formwork elements 4 without colliding with each other. If these two embodiments are combined, the side protector according to the invention can also be mounted in corner areas of adjacent transverse and longitudinal sides of formwork segments 4, and a side protector all around ceiling formwork 2 (completely) is also possible.

Pivoting base frame 14 having pivoting flap 15 is pivotably connected about axis of rotation B in the end region of second longitudinal member 18. Pivoting flap 15 has two side parts 22 that are connected to each other via two additional crossbeams 23. Side parts 22 are designed as flat plates that have a profiling in a side area. The profiling is designed as step 24 for bearing on the top side of formwork 4 (FIG. 1). One of the additional crossbeams 23 connects side parts 22 in the end area of pivoting flap 15. This additional crossbeam 23 has a coupling element 25. A locking element 25 is pivotably articulated at coupling element 26 about an axis of rotation C. Locking element 26 comprises two identically designed side plates 27 that each have a lug 28 and are connected to each other by a connecting plate not shown in FIG. 2. Coupling element 25 is arranged between two side plates 27 of locking element 26 and is pivotably mounted via an additional pin 30 that extends through side plates 27 of locking element 26 and coupling element 25.

Figure 3:
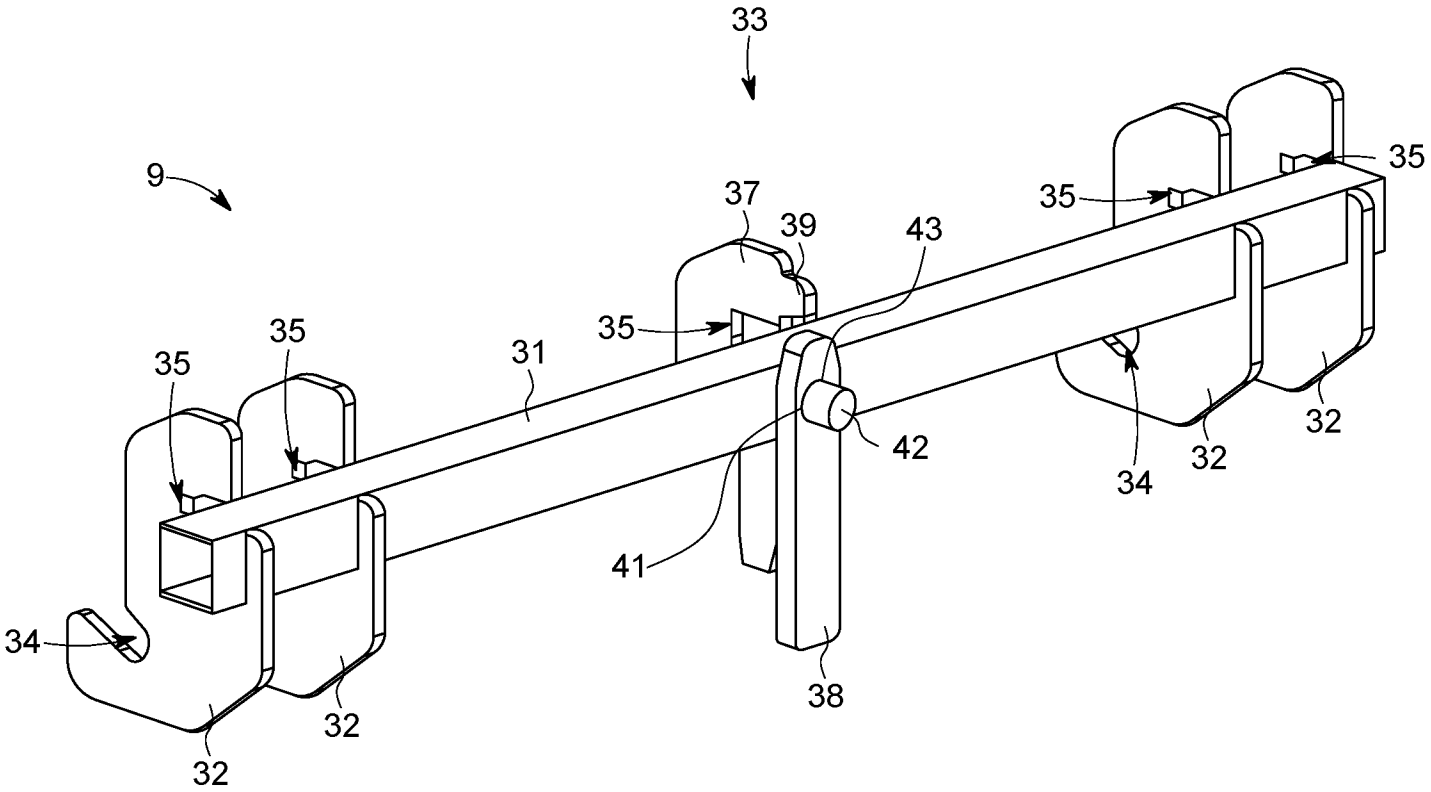
FIG. 3: a perspective view of a mounting rail.

FIG. 3 shows mounting rail 9 in a perspective representation. Mounting rail 9 has a beam 31, in each of whose end areas is arranged a pair of mounting brackets 32 and in whose center is arranged a securing flap 33. Beam 31 is designed as a hollow profile and has a square cross-section. Mounting brackets 32 are formed as flat, essentially S-shaped plates and have first notches 34 on their ends facing away from beam 31 for receiving a corresponding pin 20 that extends through first longitudinal member part 17 (FIG. 2). Each of the mounting brackets 32 forms an additional second notch 35 with beam 31 for engaging behind a projection of frame 5 (FIG. 1). Securing flap 33 has an abutment element 37 and a locking lever 38 pivotably connected to beam 31 for fastening mounting rail 9 onto frame 5 (FIG. 1). Abutment element 37 is designed as a flat, essentially sickle-shaped plate. Just as mounting brackets 32 with beam 31, abutment element 37 forms an additional notch 35 with beam 31 for engaging behind the projection of frame 5 (FIG. 1). Abutment element 37 has a wedge-shaped taper 39 at its one end for engaging in a passage opening 40 of frame 5. Securing lever 38 is pivotably connected to beam 31. For this purpose, securing lever 38 has an additional passage 41 and beam 31 has an additional pin 42. Additional pin 42 arranged on beam 31 extends through additional passage 41 of securing lever 38. A release of securing lever 38 from additional pin 42 is prevented by a cotter pin 43 inserted into additional pin 42.

In a resting position of securing lever 38, in which it is oriented transverse to beam 31, securing lever 38 blocks additional notches 35. Securing lever 38 projects over the surface of beam 31 with a free end. An insertion of the projection of frame 5 into additional notches 35 is consequently not possible. FIG. 3 shows securing lever 38 in its resting position (blocking position). If mounting rail 9 is mounted on frame 5 and securing lever 38 is in the position shown in the figure, mounting rail 9 cannot be removed.

Figure 4:
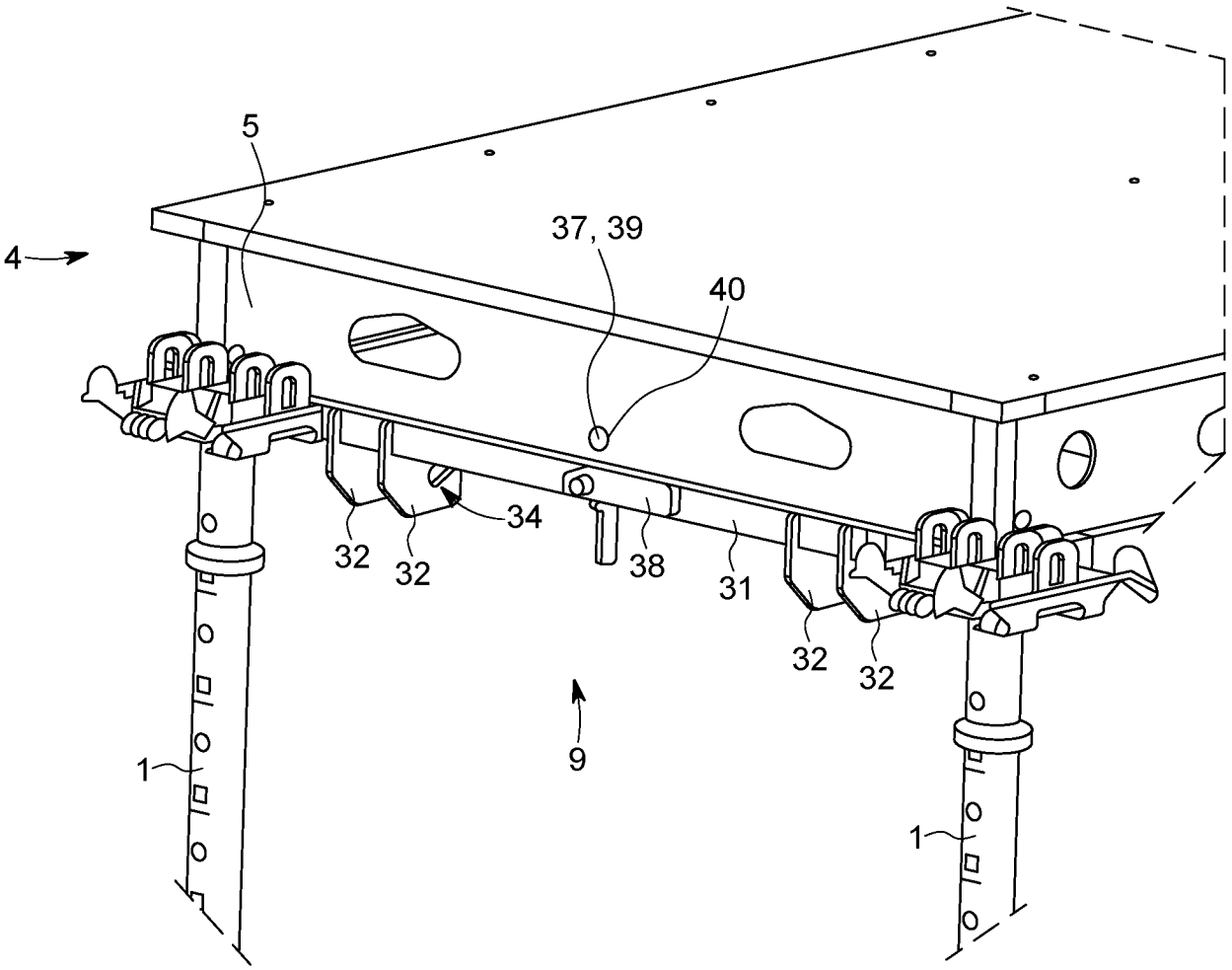
FIG. 4: a perspective view from above of the mounting rail connected to the formwork with a pivoted securing lever.

FIG. 4 shows a mounting rail 9 connected to frame 5 having a securing lever 38 oriented parallel to beam 31. In order to install mounting rail 9 on frame 5, securing lever 38 is pivoted far enough out of its resting position—against a spring force, for example—that it is oriented parallel to beam 31. This makes it possible to insert the projection of frame 5 into additional second notches 35. At the same time, the wedge-shaped taper 39 of abutment element 37 is inserted into passage opening 40 of frame 5. Mounting rail 9 is thus also stabilized on frame 5.

Figure 5:
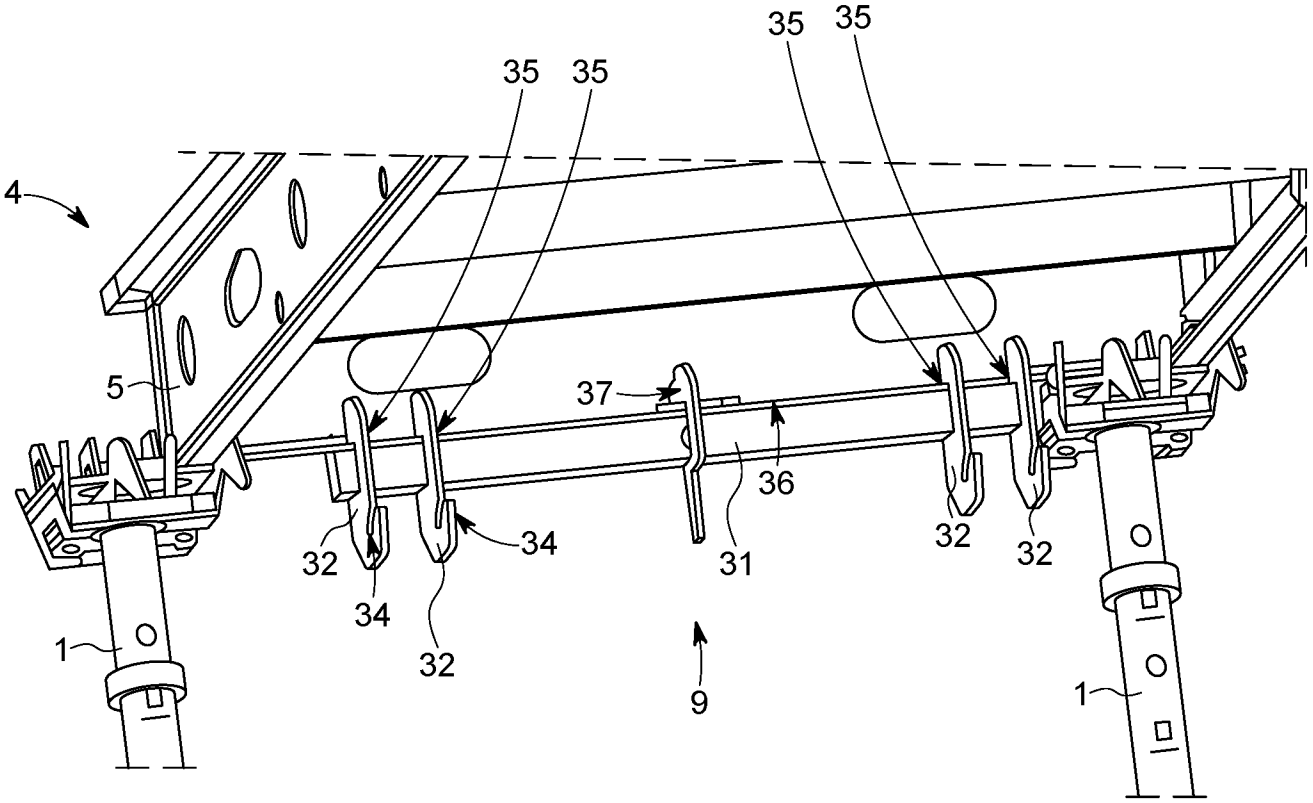
FIG. 5: a perspective view from below of the mounting rail connected to the formwork with a pivoted securing lever.

FIG. 5 shows the engagement of projection 36 of frame 5 through mounting brackets 32 and beam 31, as well as abutment element 37 that, with beam 31, forms an additional notch 35. Securing lever 38 is oriented parallel to beam 31 so that mounting rail 9 can be fitted on frame 5 and mounted securely there via a placement of securing lever 38 in its resting position.

Figure 6:
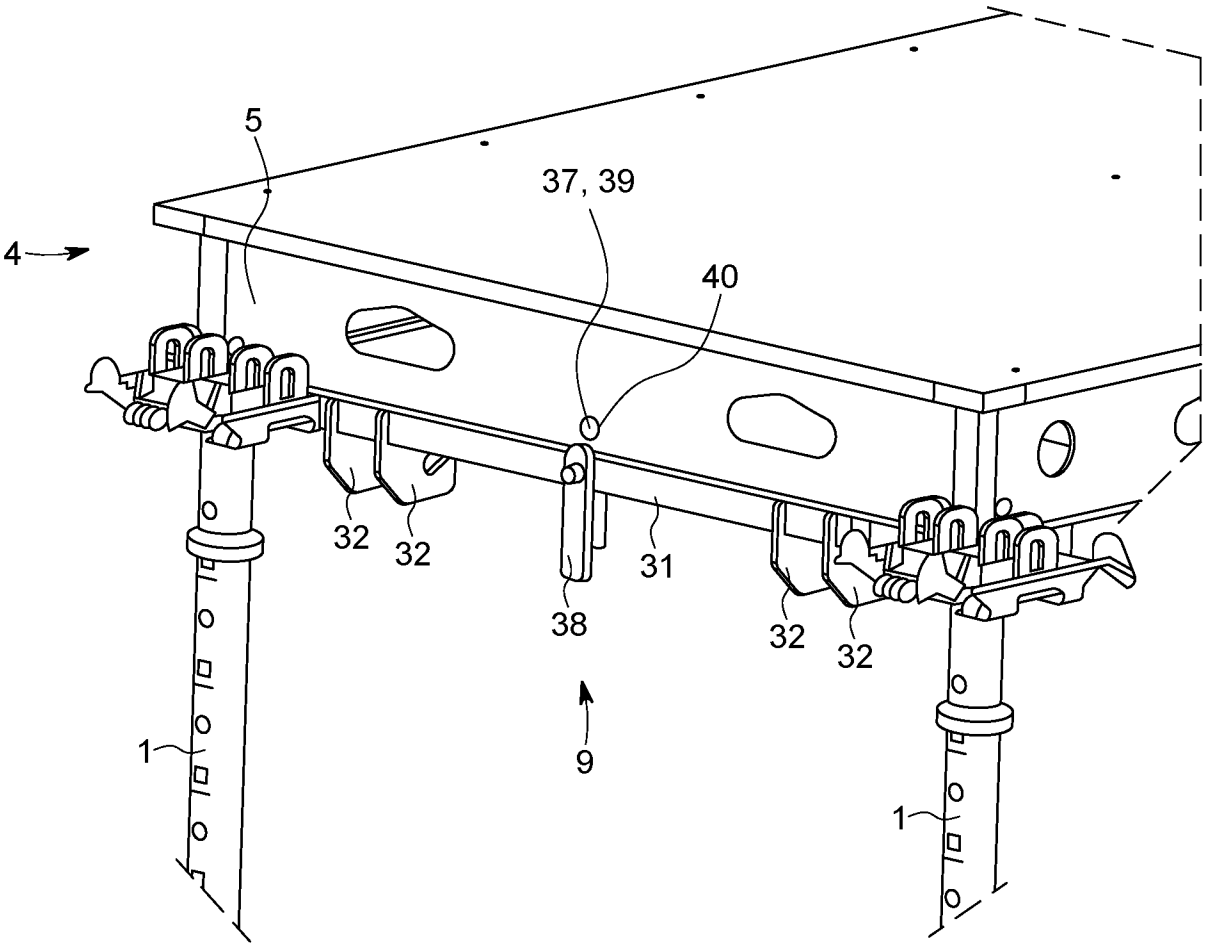
FIG. 6: a perspective view from above of the mounting rail connected to the formwork with a securing lever in the resting position (secured state)

FIG. 6 shows mounting rail 9 connected to frame 5 having securing lever 38 in resting position. After projection 36 on the interior of frame 5 is fully inserted into additional second notches 35, securing lever 38 is again pivoted back into its resting position, for example automatically by spring force. An outer side of frame 5 opposite projection 36 of frame 5 comes to rest against securing lever 38 when projection 36 of frame 5 slips out of the additional second notches 35, whereby a slipping of projection 36 of frame 5 out of the additional second notches 35 is prevented. Mounting rail 9 is thus fixed on frame 5, meaning captively secured.

Figure 7:
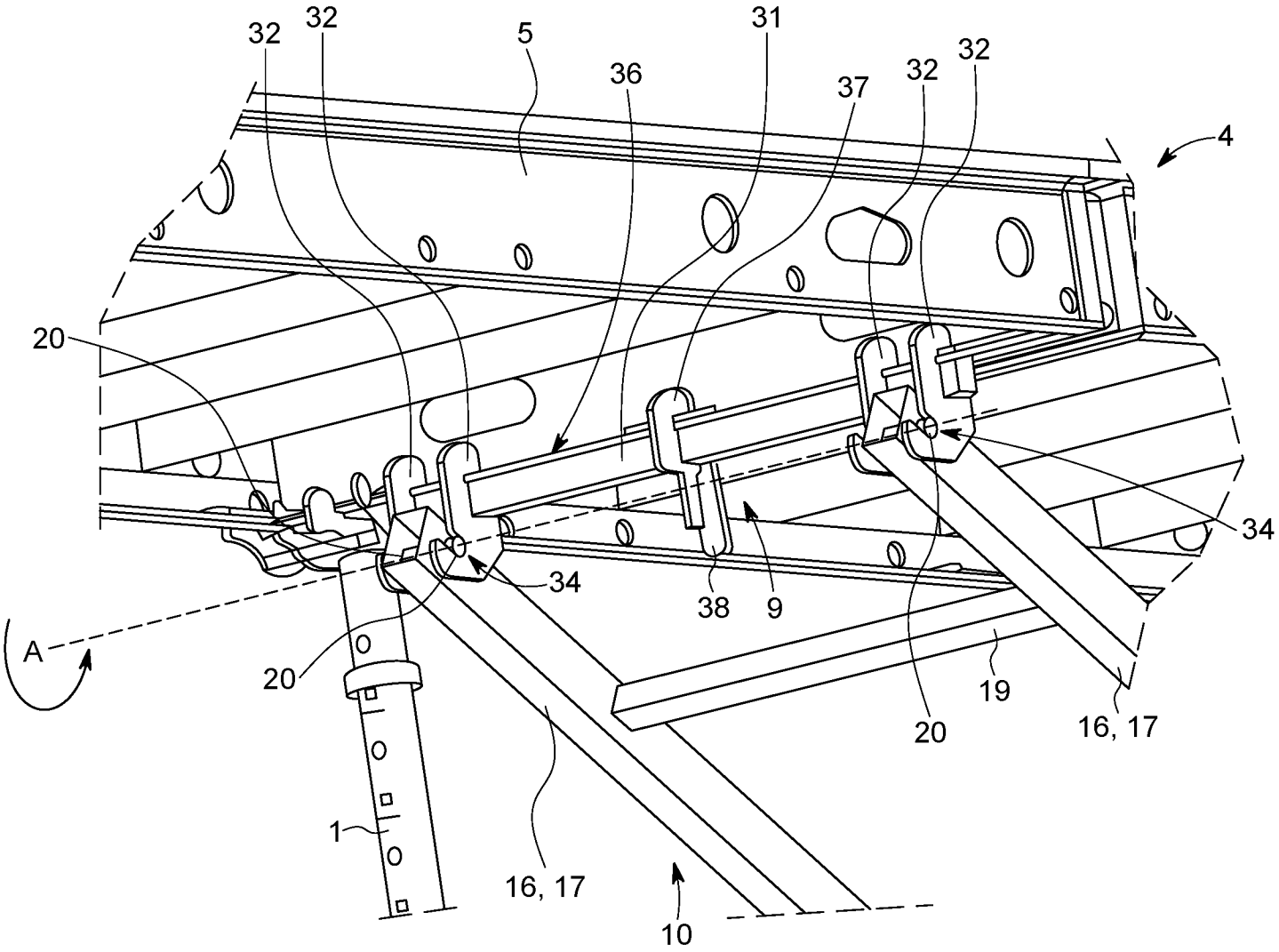
FIG. 7: a perspective view from below of the arrangement from FIG. 6 with the pivoting frame connected to the mounting rail in installation position.
Figure 8:
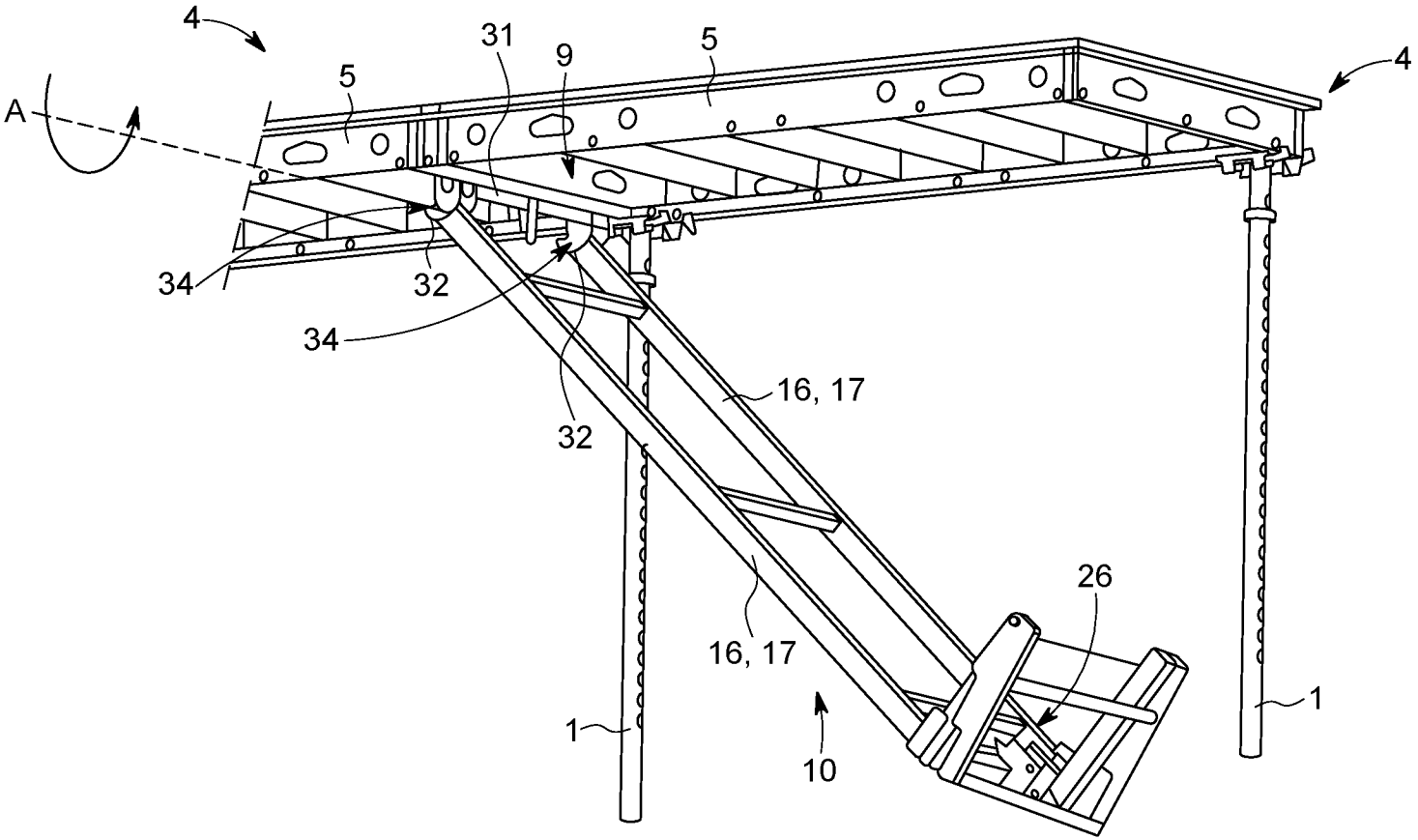
FIG. 8: an additional perspective view from below of the arrangement from FIG. 6 with the pivoting frame connected to the mounting rail in installation position.

FIG. 7 and FIG. 8 show a pivoting frame 10 in installation position with its pins 20 in mounting brackets 32 of mounting rail 9. In order to connect pivoting frame 10 to mounting rail 9, pins 20 extending through first longitudinal member part 17 are mounted in first notches 34 in mounting brackets 32. The two first longitudinal member parts 17 are each arranged for this purpose between one of the pairs of mounting brackets 32. Here, one mounting bracket 32 is to be mounted on each side of the corresponding longitudinal member part 17. Pin 20 extending away on both sides of corresponding first longitudinal member part 17 is pivotably mounted about an axis of rotation A in first notches 34 of the pair of mounting brackets 32 and rests on each side of corresponding longitudinal member part 17 in a first notch 34 of a mounting bracket 32.

Figure 9:
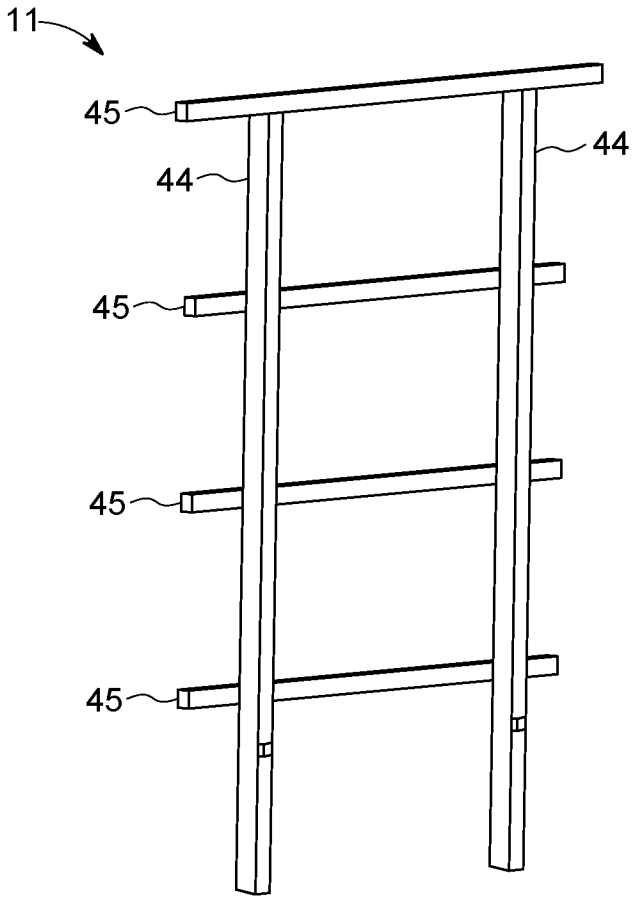
FIG. 9: a perspective view of a railing.

FIG. 9 shows a railing 11. Railing 11 has two longitudinal struts 44. Longitudinal struts 44 are connected to each other via a plurality of transverse struts 45. The connection of longitudinal struts 44 to transverse struts 45 results in a grid. Longitudinal struts 44 and transverse struts 45 are designed as hollow profiles.

Figure 10:
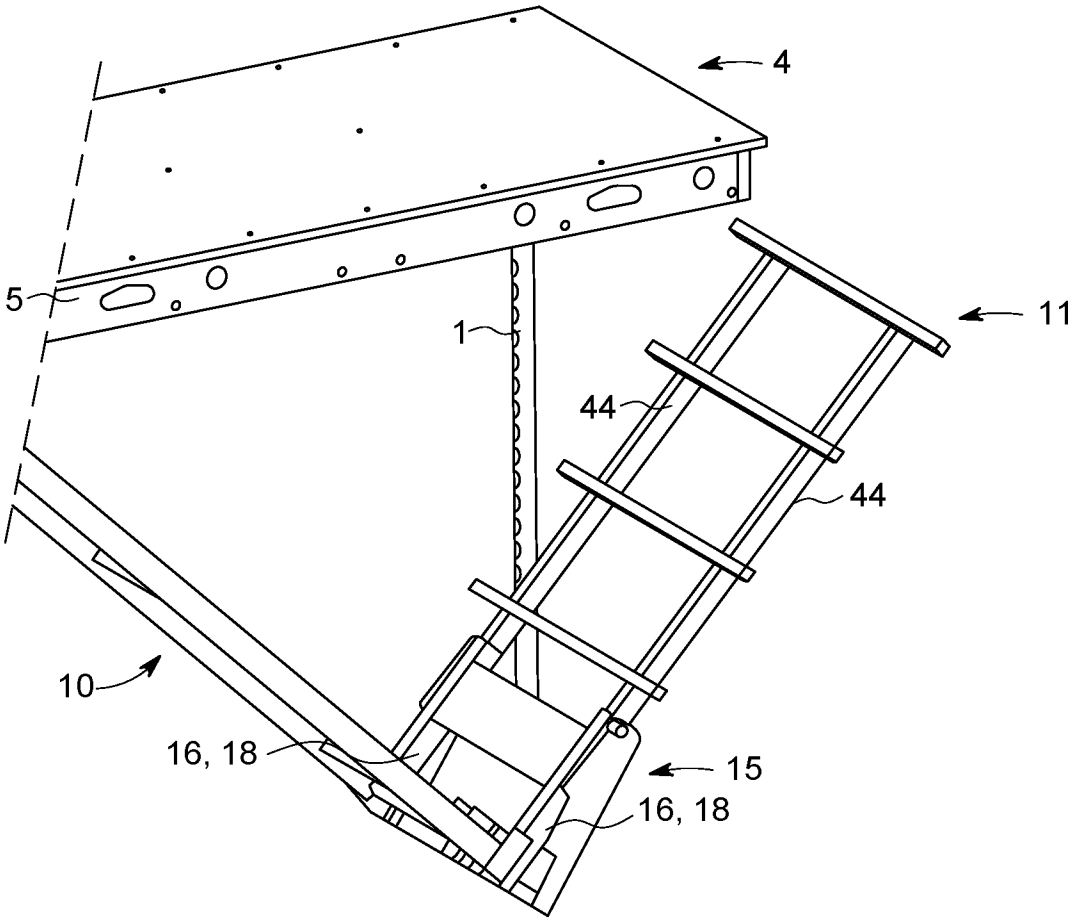
FIG. 10: a perspective view of the railing connected to the pivoting frame arranged in installation position.

FIG. 10 shows a railing 11 connected to a pivoting frame 10 arranged in the installation position. Railing 11 is mounted in pivoting frame 10. For this purpose, railing 11 is mounted having each one of its longitudinal struts 44 inserted into one of each of second longitudinal member parts 18 designed as a hollow profile.

Figure 11:
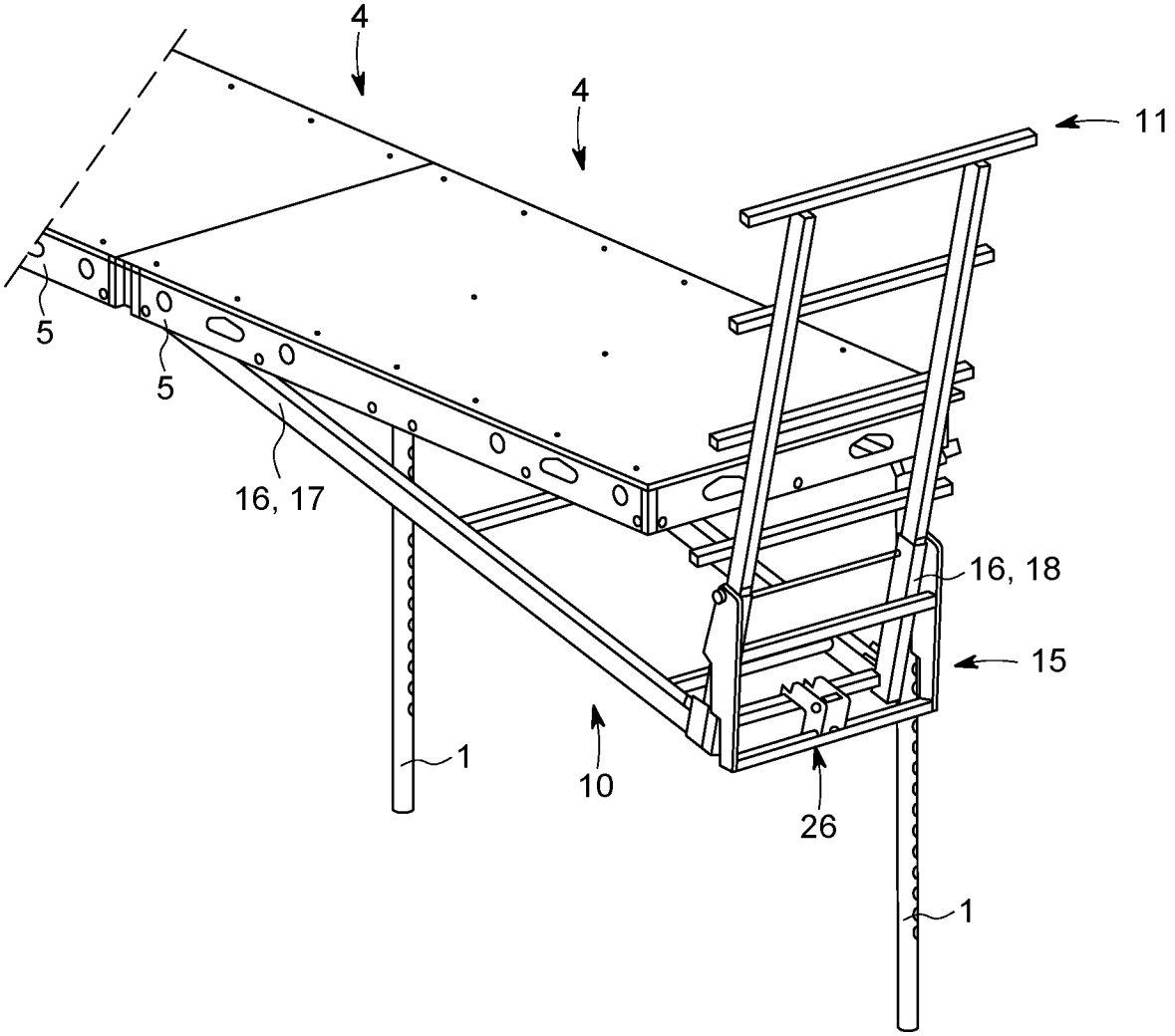
FIG. 11: a perspective view of the railing connected to the pivoting frame.

FIG. 11 shows a railing 11 connected to pivoting frame 10, wherein pivoting frame 10 is pivoted out of the installation position in the direction of the end position.

Figure 12:
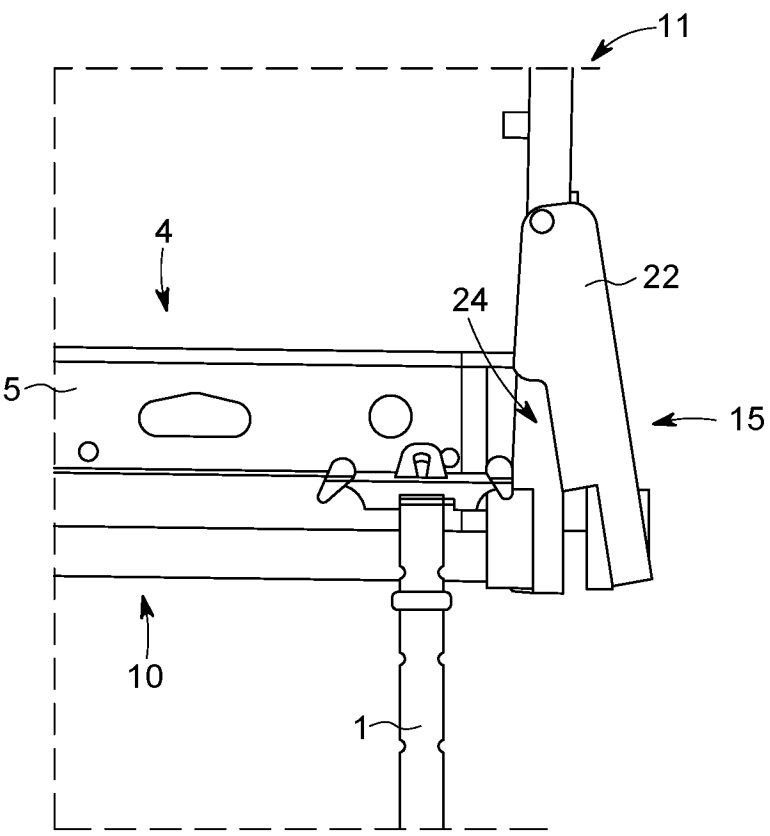
FIG. 12: a side view of the pivoting frame pivoted almost into its end position.

FIG. 12 shows pivoting frame 10 pivoted almost into its end position in a cutaway section in the area of railing 11/pivoting frame 10.

Figure 13:
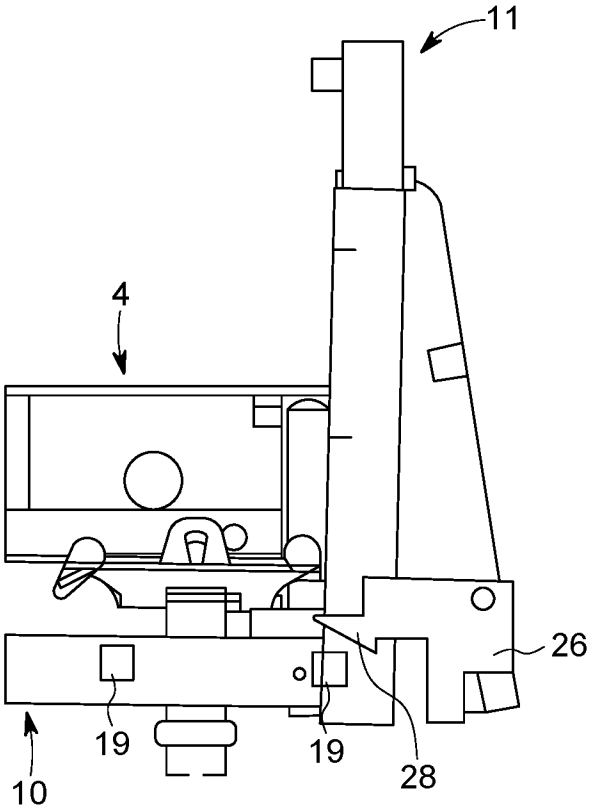
FIG. 13: a cutaway view from the side of the arrangement from FIG. 12 with a locking element not engaged behind a closest of the plurality of crossbeams.

FIG. 13 shows parts of pivoting frame 10 pivoted almost into its end position in a cut representation from the side having locking element 26.

Figure 14:
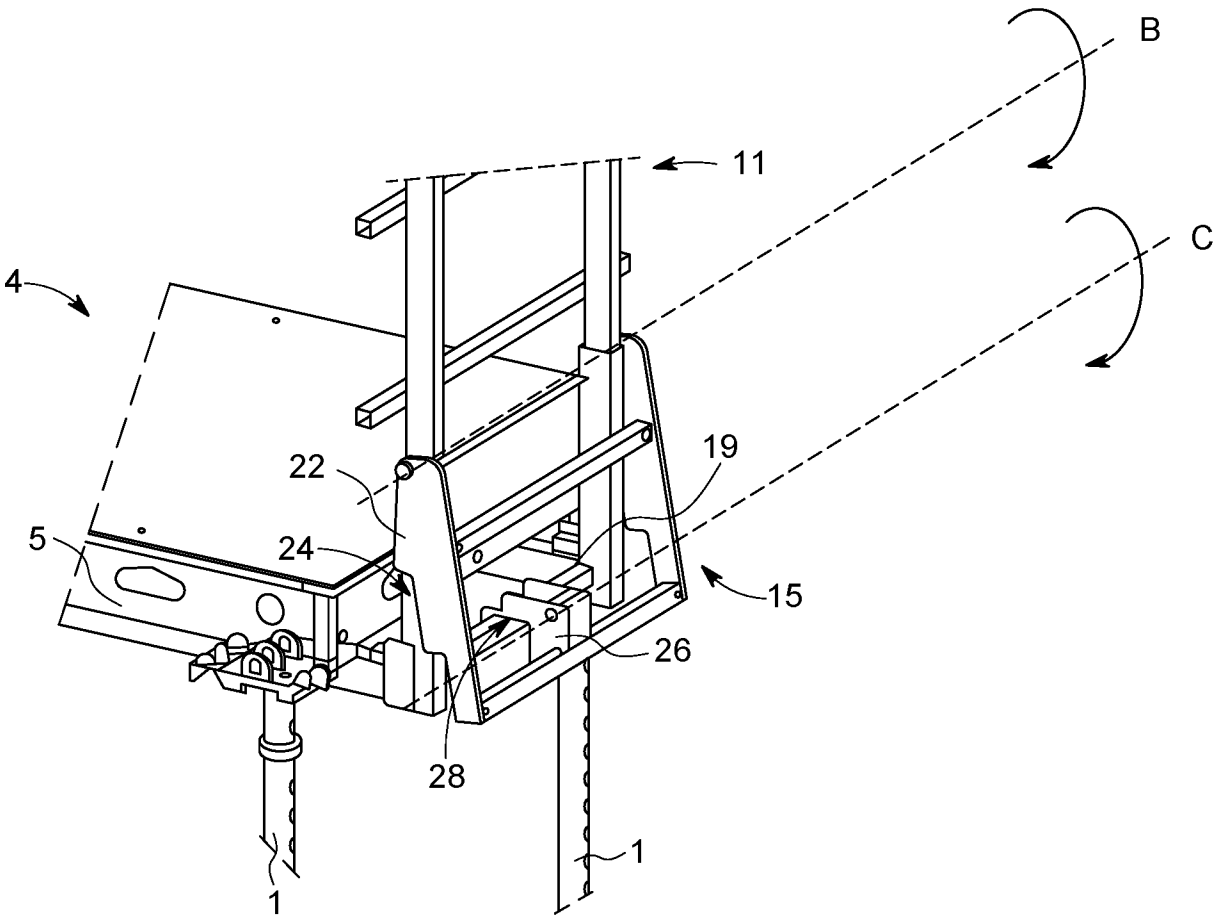
FIG. 14: a perspective view from above of the arrangement from FIG. 12 having a locking element not engaged behind the closest of the plurality of crossbeams.

FIG. 14 shows pivoting frame 10 pivoted almost into its end position in a perspective view from above. In FIG. 12, FIG. 13 and FIG. 14, pivoting flap 15 is not fully pivoted about axis of rotation B in the direction of pivoting frame 10 and lug 28 of locking element 26 does not engage behind the closest of the plurality of crossbeams 19.

Figure 15:
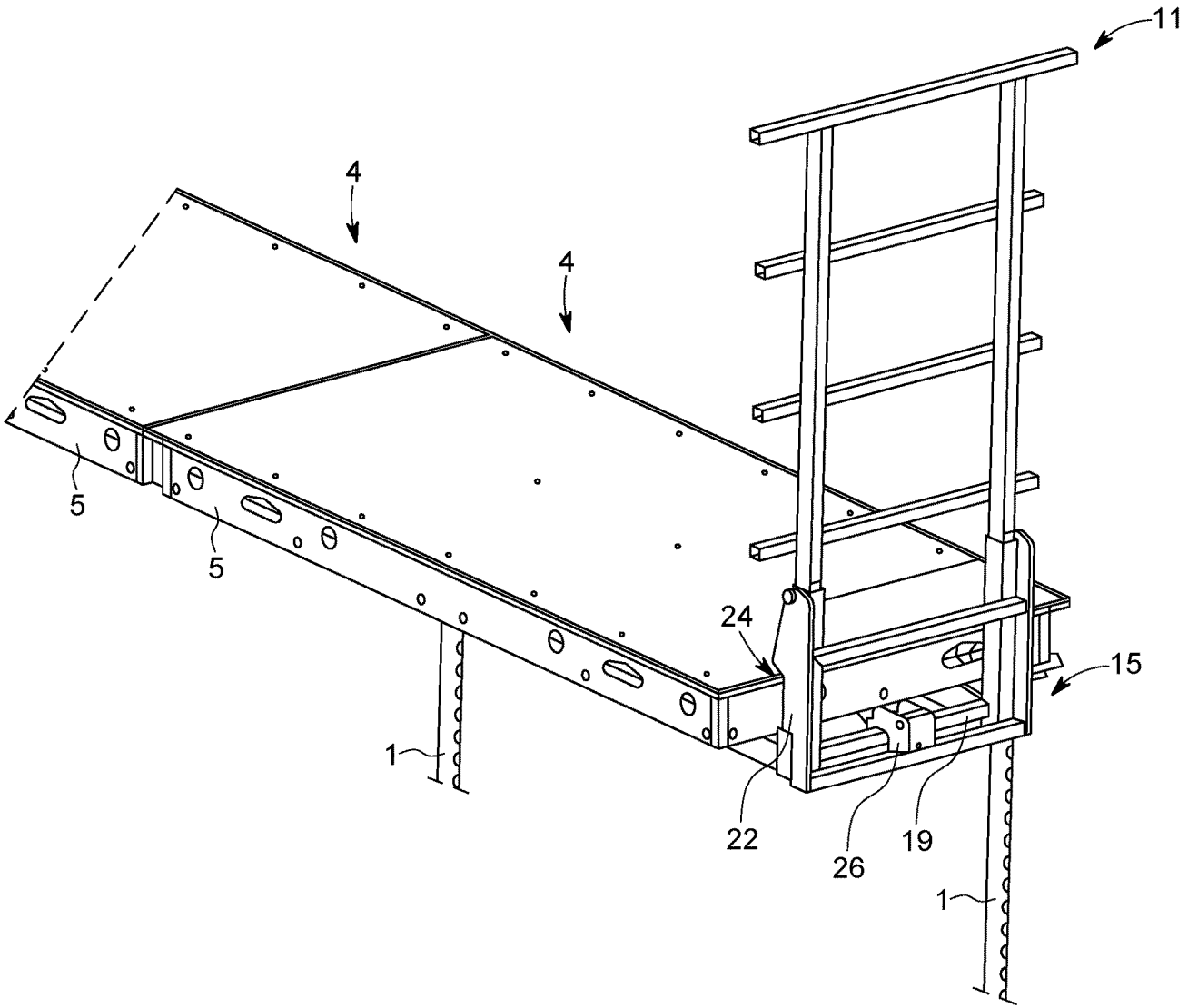
FIG. 15: a perspective view of the pivoting frame in its end position having the locking element engaged behind the closest of the plurality of crossbeams.

FIG. 15 shows pivoting frame 10 in its end position on the transverse side of a formwork element 4 having locking element 26 engaged behind the closest of the plurality of crossbeams 19.

Figure 16:
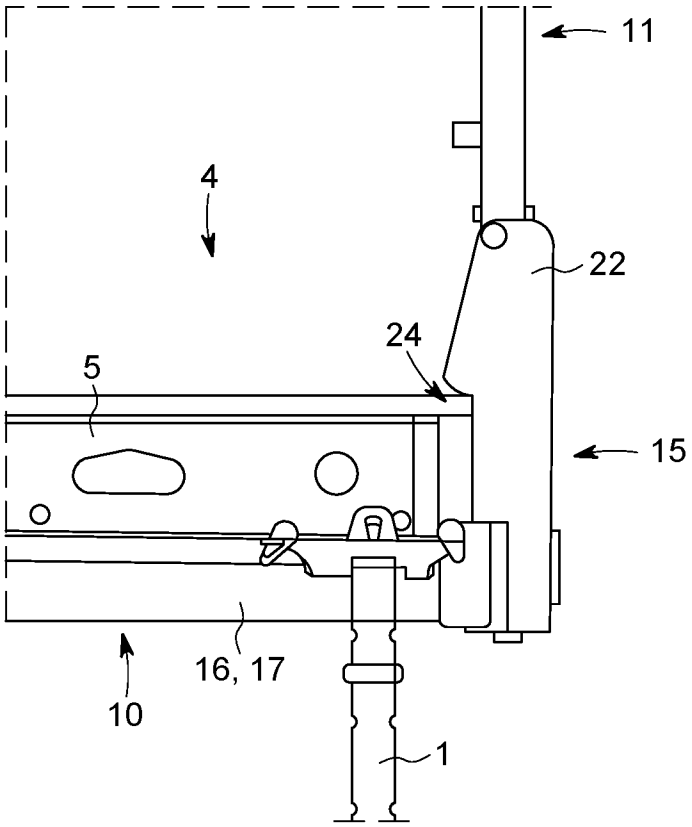
FIG. 16: a side view of the arrangement from FIG. 15.

FIG. 16 shows a perspective view of pivoting frame 10 in its end position having locking element 26 engaged behind the closest of the plurality of crossbeams 19.

Figure 17:
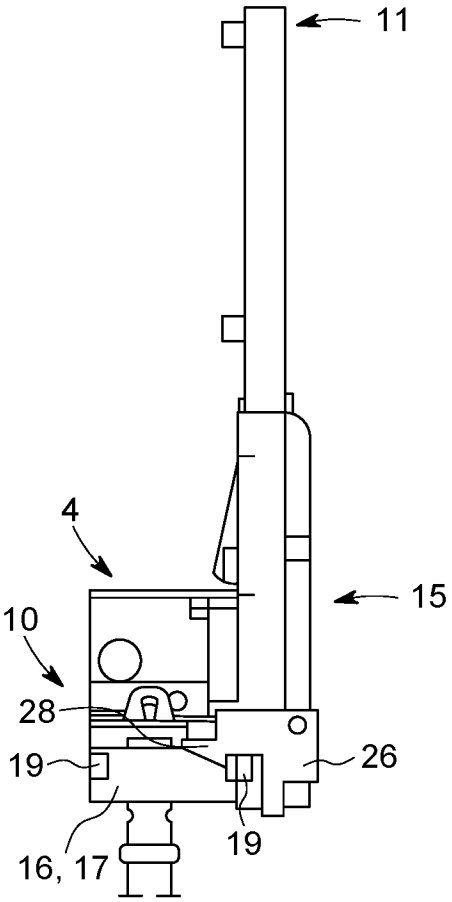
FIG. 17: a cutaway view from the side of the pivoting frame in its end position having the locking element engaged behind the closest of the plurality of crossbeams.

FIG. 17 shows a cutaway view from the side of pivoting frame 10 in its end position with locking element 26 engaged by its lug 28 behind the closest of the plurality of crossbeams 19.

Figure 18:
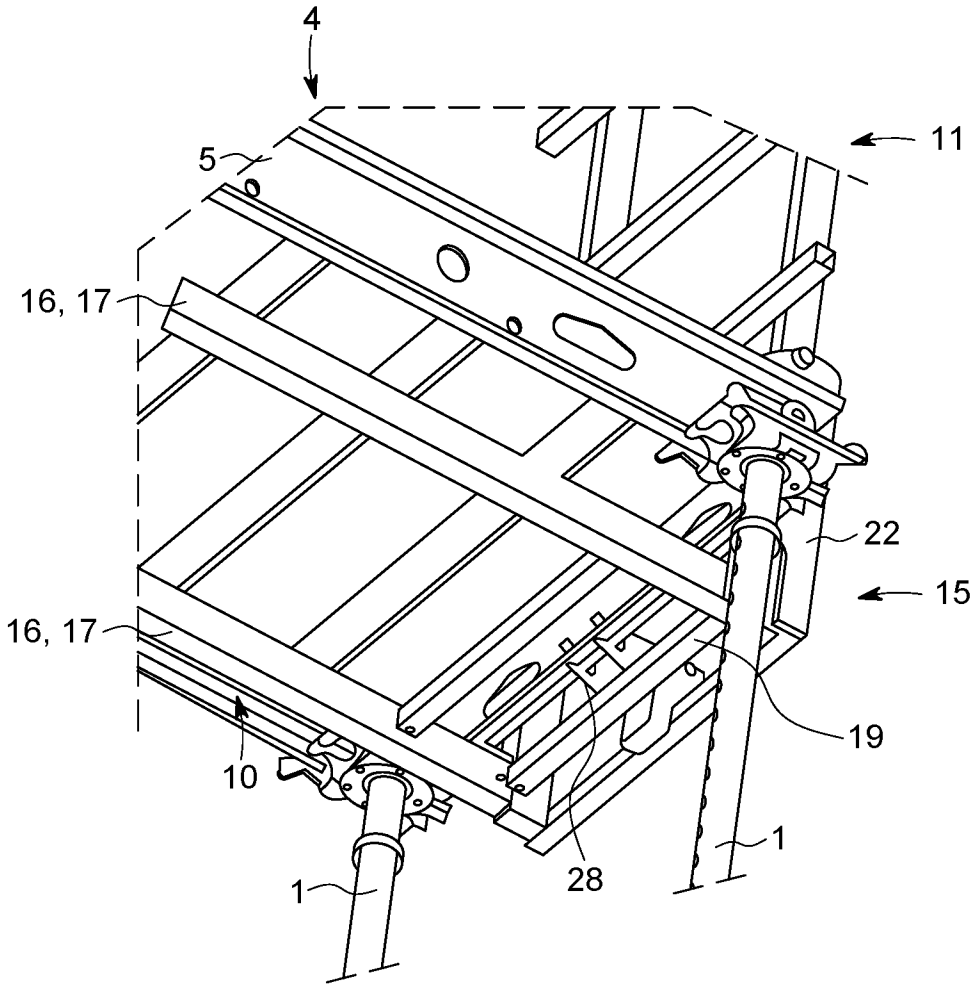
FIG. 18: a perspective view from below of the pivoting frame in its end position having the locking element engaged behind the closest of the plurality of crossbeams.

FIG. 18 shows a perspective view from below of pivoting frame 10 in its end position with locking element engaged by its lug 28 behind the closest of the plurality of crossbeams 19. If pivoting frame 10 is fully pivoted into the end position, first longitudinal member parts 17 are oriented essentially parallel to formwork elements 4. For securing pivoting frame 10 in this position to formwork element 4, pivoting flap 15 is fully pivoted with respect to pivoting frame 10 about axis of rotation B in the direction of pivoting frame 10. Step 24 designed in each of side parts 22 of pivoting flap 15 (see FIG. 16) thus comes to rest on the top side of formwork 4, whereby pivoting frame 10 is supported on formwork 4. Simultaneously, lug 28 engages behind the closest of the plurality of crossbeams 19 and locks to this, whereby a slippage of step 24 built into each side part 22 of pivoting flap 15 from the top side of formwork element 4 is prevented.

FIG. 19 shows a second embodiment of a pivoting frame 50 having spacer support pieces 52, 54, 56, 58 that are provided on first longitudinal member parts 17' and second longitudinal member parts 18'. Pins 20' that form axis of rotation A between pivoting frame 50 and the mounting rail not shown in the figure are designed in the end area of spacer support pieces 52, 54.

All further embodiments of pivoting frame 50 correspond to the technical embodiments as they are described in FIG. 2, in particular, and to pivoting frame 10 in FIGS. 1 to 18.

FIG. 20 shows in a side view how two pivoting frames cross over each other and are mounted on the bottom side of formwork elements.

Formwork elements 4 form and illustrate the cutaway section of a ceiling formwork. Mounting rails 9 are installed on a longitudinal side as well as on a transverse side on the bottom side of the formwork elements, as described in the figures. On the longitudinal side, pivoting frame 50 is mounted in mounting rail 9 and pivoting frame 10 is pivotably mounted in the other mounting rail 9 shown. Pivoting frame 50 is also held pivotably guided by pins 21 that are formed in support spacer piece 52.

In FIG. 20, Support spacer piece 56 is shown that enables a pivotable side part 22' to engage with a formwork element 4 on the top side of formwork element 4. Side part 22' is shown in the locked position and holds the side protector securely on the edge of the formwork. The longitudinal side with railing 11 is secured via pivoting frame 50.

Pivoting frame 10 that secures the transverse side of a ceiling formwork via a railing 11 is mounted between pivoting frame 50 and the bottom side of formwork element 4. FIG. 20 shows a corner covering with a side protector on each of the transverse and longitudinal sides.

A side protector 3 is disclosed for a ceiling formwork 2. Ceiling formwork 2 comprises at least one formwork element 4 with a frame 5. Side protector 3 has a railing 11. Side protector 3 further has a pivoting frame 10. Railing 11 is connected to pivoting frame 10. Pivoting frame 10 can be connected to frame 5 in a direct or indirect manner from the bottom side of ceiling formwork 2. Pivoting frame 10 can be pivoted from an installation position about an axis of rotation A into an end position in such a manner that ceiling formwork 2 is laterally secured by railing 11. In addition, a ceiling formwork system 100 having at least one corresponding side protector 3 and one ceiling formwork 2 is specified. A method for erecting such a side protector 3 is also specified.

The invention claimed is:

1. A side protector for ceiling formwork, wherein the formwork comprises at least one formwork element having a frame, the side protector comprising:

a railing; and a pivoting frame to which the railing is connected and which is indirectly connected to the frame from a bottom side of the ceiling formwork, the pivoting frame being pivotable from an installation position into an end position about an axis of rotation (A) such that the ceiling formwork is laterally secured by the railing and the pivoting frame is pivotably connected to a mounting rail about the axis of rotation (A), the mounting rail being connected to the frame and in the installed state having a horizontal alignment or orientation.

2. The side protector according to claim 1, wherein the pivoting frame comprises a pivoting base frame and a pivoting flap, the pivoting flap being pivotably connected to the pivoting base frame about an axis of rotation (B).

3. The side protector according to claim 2, wherein the pivoting base frame has two longitudinal members, the two longitudinal members being connected to each other via at least one of a plurality of crossbeams or transverse connectors.

4. The side protector according to claim 3, wherein each of the two longitudinal members has a through-hole, a pin being arranged in the through-hole that extends through each of the two longitudinal members and projects from the longitudinal members on both sides.

5. The side protector according to claim 2, wherein the pivoting flap has two side parts that are connected to each other via at least one additional crossmember, each of the two side parts having in an edge area a step for bearing on a top side of the formwork element.

6. The side protector according to claim 5, wherein at least one coupling element is arranged on the at least one additional crossmember, wherein a locking element for engaging behind one of the plurality of crossmembers is articulated at the coupling element about an axis of rotation (C).

7. The side protector according to claim 1, wherein the mounting rail comprises a beam on which at least one of two pairs of mounting brackets or a securing flap are arranged.

8. The side protector according to claim 7, wherein each of the mounting brackets has at their ends away from the beam a first notch for receiving the pin.

9. The side protector according to claim 7, wherein the securing flap has an abutment element or a securing lever pivotably connected to the beam for fastening the mounting rail on the frame.

10. The side protector according to claim 9, wherein the mounting brackets of the beam or the abutment element of the beam each form an additional notch for engaging behind a projection of the frame.

11. The side protector of claim 4, further comprising a spacer support piece being provided at each free end of the longitudinal members that has the pin in the region of each free end.

12. A ceiling formwork system having at least one side protector and a ceiling formwork, the at least one side protector being installed on the ceiling formwork, the at least one side protector comprising:

a railing; and a pivoting frame to which the railing is connected and which is indirectly connected to the frame from a bottom side of the ceiling formwork, the pivoting frame being pivotable from an installation position into an end position about an axis of rotation (A) such that the ceiling formwork is laterally secured by the railing and the pivoting frame is pivotably connected to a mounting rail about the axis of rotation (A), the mounting rail being connected to the frame and in the installed state having a horizontal alignment or orientation.

13. A ceiling formwork system, comprising:

a ceiling formwork having a frame; and at least one side protector, the at least one side protector being installed on the ceiling formwork, the at least one side protector including, a railing, and a pivoting frame to which the railing is connected and which is indirectly connected to the frame from a bottom side of the ceiling formwork, the pivoting frame being pivotable from an installation position into an end position about an axis of rotation (A) such that the ceiling formwork is laterally secured by the railing and the pivoting frame is pivotably connected to a mounting rail about the axis of rotation (A), the mounting rail being connected to the frame and in the installed state having a horizontal alignment or orientation.

14. A method for erecting a side protector for a ceiling formwork according to claim 1, the ceiling formwork comprising at least one formwork element having a frame, the method comprising:

indirectly or directly connecting a pivoting frame to the frame;

connecting a railing to the pivoting frame;

swinging the pivoting frame up from an installation position into an end position about an axis of rotation (A) such that the ceiling formwork is laterally secured by the railing.

15. The method for erecting a side protector for a ceiling formwork according to claim 14, wherein the pivoting frame is pivotably installed on a mounting rail, which is attached on the bottom side of the formwork element or on a bottom side of a directly adjacent formwork element if the directly adjacent formwork element relates to the side protector for a transverse side of a formwork element that terminates a ceiling formwork in a delimiting manner.

16. The method for erecting a side protector for a ceiling formwork according to claim 14, wherein the pivoting frame is pivotably installed on a mounting rail, which is fastened to a bottom side of a formwork element or to a bottom side of a formwork element that is spaced apart from a formwork element which borders a ceiling formwork with the interposition of an additional formwork element if it involves the side protector for a longitudinal side of a formwork element.

* * * * *